US005127295A

United States Patent [19]

Hax et al.

[11] Patent Number: 5,127,295

[45] Date of Patent: Jul. 7, 1992

[54] APPARATUS FOR SLITTING A LONGITUDINALLY MOVING WEB

[75] Inventors: Wolfgang Hax, Neunkirchen-Seelscheid; Josef Nowak, Siegburg, both of Fed. Rep. of Germany

[73] Assignee: Reifenhäuser GmbH Maschinenfabrik, Troisdorf, Fed. Rep. of Germany

[21] Appl. No.: 682,114

[22] Filed: Apr. 5, 1991

[30] Foreign Application Priority Data

Apr. 18, 1990 [DE] Fed. Rep. of Germany ..... 4012321

[51] Int. Cl.[5] ..... B26D 1/24

[52] U.S. Cl. ..... 83/425.4; 83/498; 83/499; 83/508.2; 83/508.3

[58] Field of Search ..... 83/499, 498, 425, 425.4, 83/504, 508.2, 508.3, 500, 501, 508.1

[56] References Cited

U.S. PATENT DOCUMENTS

| | | | |
|---|---|---|---|
| 3,886,833 | 6/1975 | Gunn et al. | 83/499 |
| 4,069,749 | 1/1978 | Olsen et al. | 83/498 |
| 4,077,291 | 3/1978 | Obenshain | 83/499 |
| 4,269,097 | 5/1981 | Linn | 83/504 |
| 4,516,454 | 5/1985 | Mosburger | 83/499 |
| 4,887,502 | 12/1989 | Voges | 83/499 |

*Primary Examiner*—Frank T. Yost
*Assistant Examiner*—Allan M. Schrock
*Attorney, Agent, or Firm*—Herbert Dubno; Andrew M. Wilford

[57] ABSTRACT

An apparatus for longitudinally cutting a longitudinally moving web has upper and lower guides flanking the web and extending transversely thereof parallel to each other, respective upper and lower blade holders riding on and displaceable along the guides transversely of the web, respective upper and lower blades on the holders engageable with the web, and respective upper and lower threaded adjustment spindles extending through the holders. Respective upper and lower half nuts are movable on the holders between coupled positions threadedly engaging the respective spindles and coupling the respective holders thereto and uncoupled positions out of engagement with the respective spindles. Respective upper and lower clamping rods extend through the holders and respective upper and lower clamping shoes are displaceable on the holders between clamping positions engaging the respective spindles and locking the respective holders thereon and released positions out of engagement with the respective spindles. Actuators are provided to displace the half nuts of the respective holders into the coupled position and to displace the respective shoes into the released position in an adjustment mode and to displace the half nuts of the holders into the uncoupled positions and to displace the shoes into the blocking position in a cutting mode. A drive rotates the spindles and thereby transversely displaces the holders and blades only in the adjustment mode of the actuator.

5 Claims, 3 Drawing Sheets

APPARATUS FOR SLITTING A LONGITUDINALLY MOVING WEB

FIELD OF THE INVENTION

The present invention relates to an apparatus for longitudinally cutting or slitting a longitudinally moving web. More particularly this invention concerns such a device used to transversely subdivide a synthetic-resin sheet, film, or fleece as it is being made.

BACKGROUND OF THE INVENTION

A typical apparatus for longitudinally cutting a longitudinally moving web has a pair of blades, normally termed upper and lower blades although side-by-side horizontal orientation is equally possible, that ride on respective transverse guides that both extend parallel to each other crosswise of the goods being cut. The web passes between the guides and the two blades are positioned immediately adjacent or even in contact with each other to cut the web.

Each blade is normally a disk rotatable about an axis perpendicular to the longitudinal direction of travel of the web and is carried on a respective holder that can slide transversely along the respective guide. A respective spindle is threaded through a nut in each such holder, with these spindles extending parallel to the respective guides and, therefore, parallel to each other. The two spindles are furthermore connected together for joint synchronous rotation so as to move the respective guides transversely in order to change and set the positions of the respective blades. This makes it possible to vary the widths of the strips being cut from the web.

When the device is in use the holders are invariably subjected to some forces parallel to the guides. Since the motors for the spindles are disconnected from them except during an adjustment operation, this can back drive these motors, thereby throwing the cutters out of position.

OBJECTS OF THE INVENTION

It is therefore an object of the present invention to provide an improved system for longitudinally cutting a longitudinally moving web.

Another object is the provision of such an improved system for longitudinally cutting a longitudinally moving web which overcomes the above-given disadvantages, that is which can be adjusted accurately but that will not move out of adjustment once in position.

SUMMARY OF THE INVENTION

An apparatus for longitudinally cutting a longitudinally moving web according to the invention has upper and lower guides flanking the web and extending transversely thereof parallel to each other, respective upper and lower blade holders riding on and displaceable along the guides transversely of the workpiece, respective upper and lower blades on the holders engageable with the workpiece, and respective upper and lower threaded adjustment spindles extending through the holders. Respective upper and lower half nuts are movable on the holders between coupled positions threadedly engaging the respective spindles and coupling the respective holders thereto and uncoupled positions out of engagement with the respective spindles. Respective upper and lower clamping rods extend through the holders and respective upper and lower clamping shoes are displaceable on the holders between clamping positions engaging the respective spindles and locking the respective holders thereon and released positions out of engagement with the respective spindles. Actuators are provided to displace the half nuts of the respective holders into the coupled position and to displace the respective shoes into the released position in an adjustment mode and to displace the half nuts of the holders into the uncoupled positions and to displace the shoes into the blocking position in a cutting mode. A drive rotates the spindles and thereby transversely displaces the holders and blades only in the adjustment mode of the actuator.

Thus with this system the blades are positively locked in place once they have been moved into the desired positions, and once in these positions the half nuts are moved out, completely protecting them from harm. In addition the position for the lower blade is adjusted as simply as that for the upper blade. The adjustment for the lower blade takes place below the web being cut without having to do anything below the web or move this web out of the way. Since a separate clamping rod is provided the established position cannot change. Sufficient friction is provided between the clamping rod and shoe by means of a spring force or the force of the pneumatic o hydraulic actuator to maintain the holder in place once it is set.

According to another feature of this invention the actuator includes a respective fluid-powered piston-and-cylinder unit braced between each half nut and the respective holder and another fluid-powered piston-and-cylinder unit braced between each clamping shoe and the respective holder. The drive includes a drive element interconnecting the threaded spindles for joint synchronous rotation.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
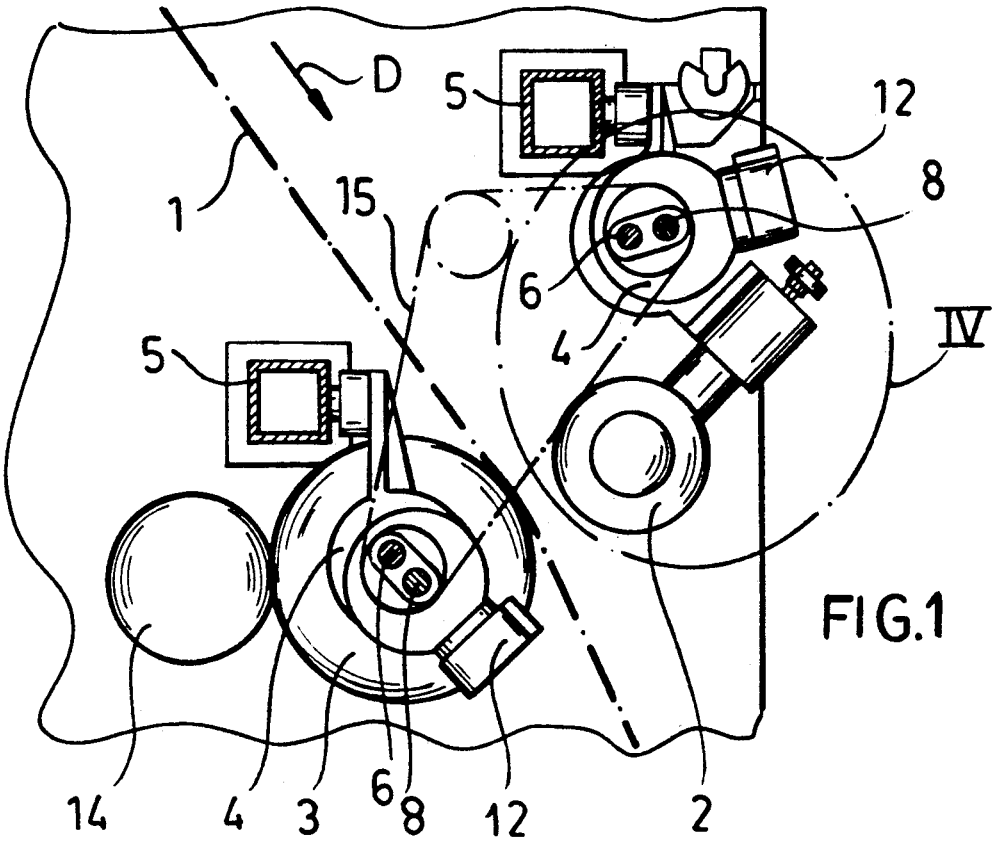
FIG. 1 is small-scale vertical section partly diagrammatic through the apparatus according to this invention.

As seen in FIG. 1 a web 1 moves in a downward longitudinal transport direction D. This web 1 is slit longitudinally by an upper blade 2 and a lower blade 3, carried on substantially identical holders 4 and each constituted as a thin metal disk lying in a plane parallel to the direction D and rotatable about an axis perpendicular to the direction D.

Each holder 4 rides on a respective square-section transverse guide beam 5 that extends perpendicular to the direction D, with the web 1 running between the two beams 5. Slightly underneath each such beam 5 is a respective threaded adjustment spindle 6 and immediately adjacent each such spindle 6 is a smooth cylindrical clamping rod 8. The spindles 6 are connected together by a sprocket chain 15 and can be synchronously rotated by a motor 16. A friction roller 14 rotates the disk blade 3 and the blade 2 can idle.

Figure 3:
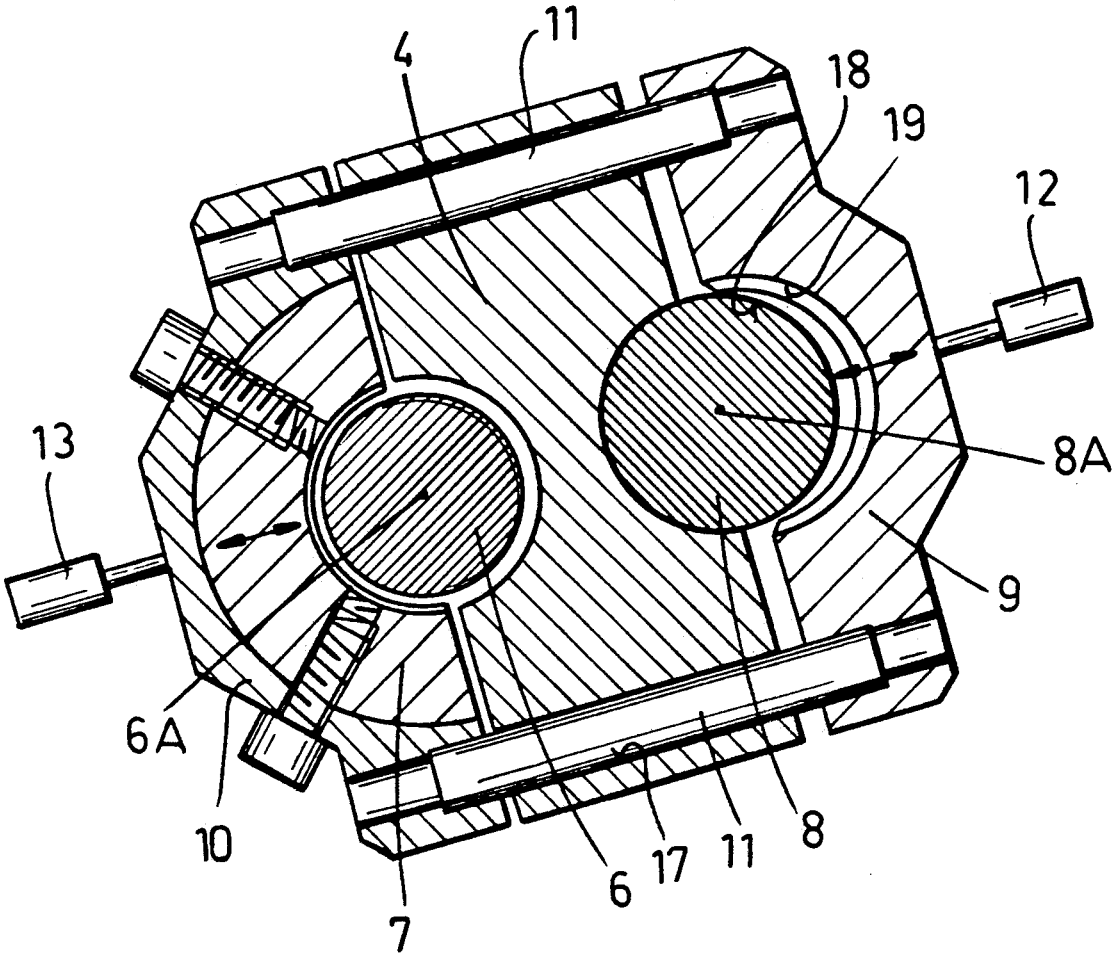
FIG. 3 is a large-scale cross section through the upper holder.

As seen in FIG. 3, each holder 4 is provided with a half nut 7, that is a semicylindrical element formed internally with a screwthread formation complementary to that of the respective rod 6. The half nut 7 is held in a yoke 10 that is supported in rods 11 fitted in bores 17 in the holder 4 so that the yoke 10 and half nut 7 can move radially of the axis 6A of the rod 6, between a position out of contact with same and permitting the rod 6 to rotate without affecting the holder and a position engaging the thread of the rod 6 so that rotation of this rod 6 moves the holder 4 along the axis 6A in a direction depending on the rotation direction of the two rods 6 and 8. These rods 11 flank the plane of the axes 6A and 8A.

Each holder 4 is formed with a semicylindrical seat in which the rod 8 fits and is provided with a clamping shoe 9 having another semicylindrical seat 19 that can be fitted over the surface 18 of the rod 8. This shoe 9 is carried on the ends of the rods 11 opposite the ends screwed into the yoke 10 so that it can move radially of the axis 8A of the rod 8, synchronously with the yoke 10 and half nut 7. Thus when the half nut 7 is in mesh with the rod 6 as shown in FIG. 3, the shoe 9 is spaced from the rod 8 which can therefore slide freely in the seat 18. When the half nut 7 is pulled back out of engagement with the rod 6, however, the shoe 9 is pulled into tight clamping engagement with the rod 8, locking the holder 4 on the rod 8 which is neither rotatable nor axially movable in the apparatus.

Figure 4:
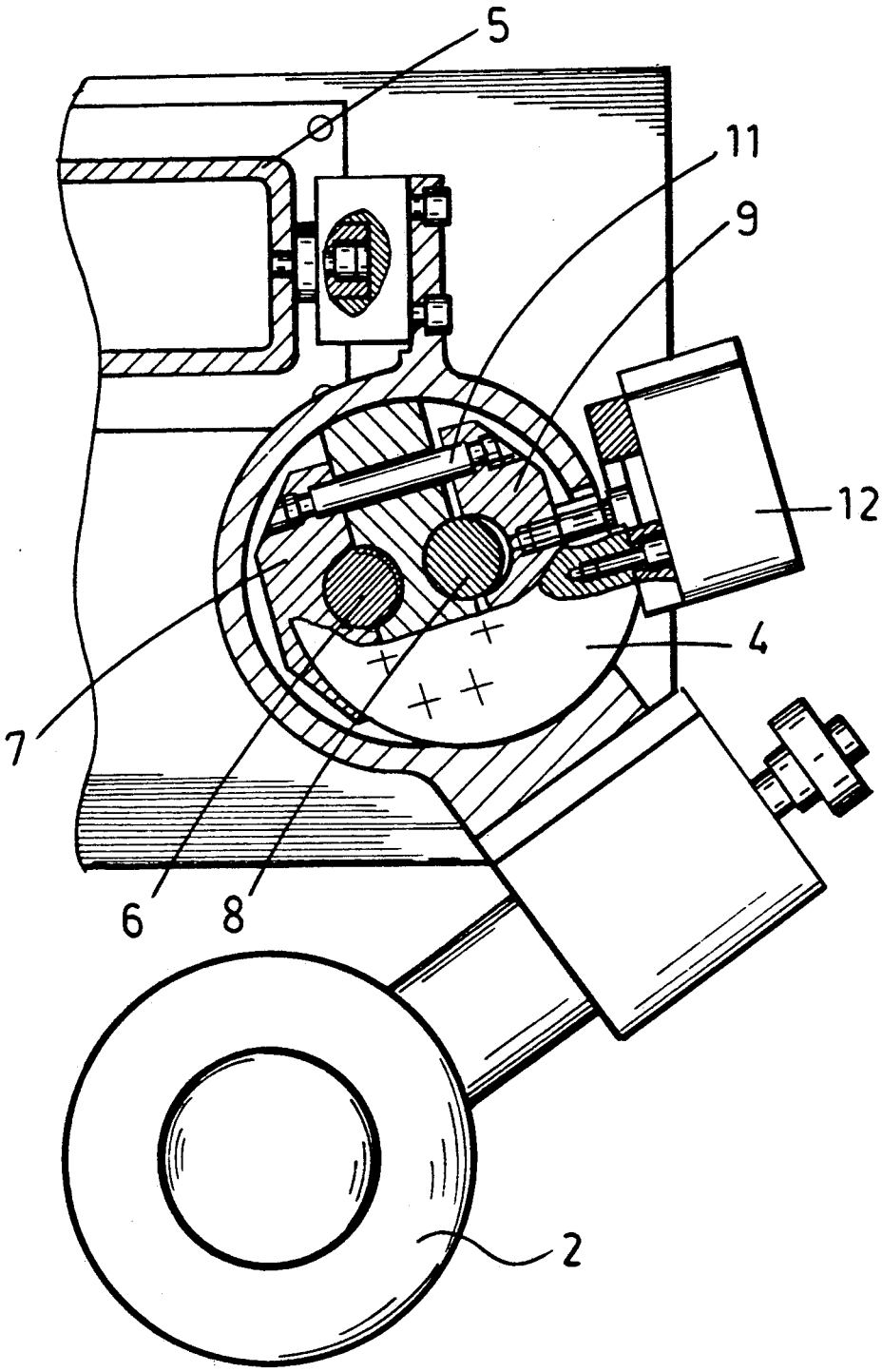
FIG. 4 is a large-scale partly sectional view of the detail indicated at IV in FIG. 1.

A hydraulic actuator 12 shown schematically in FIG. 3 and structurally in FIG. 4 can move the shoe 9 and another such actuator 13 shown diagrammatically in FIG. 3 only can move the yoke 10 and nut 7 oppositely.

Figure 2:
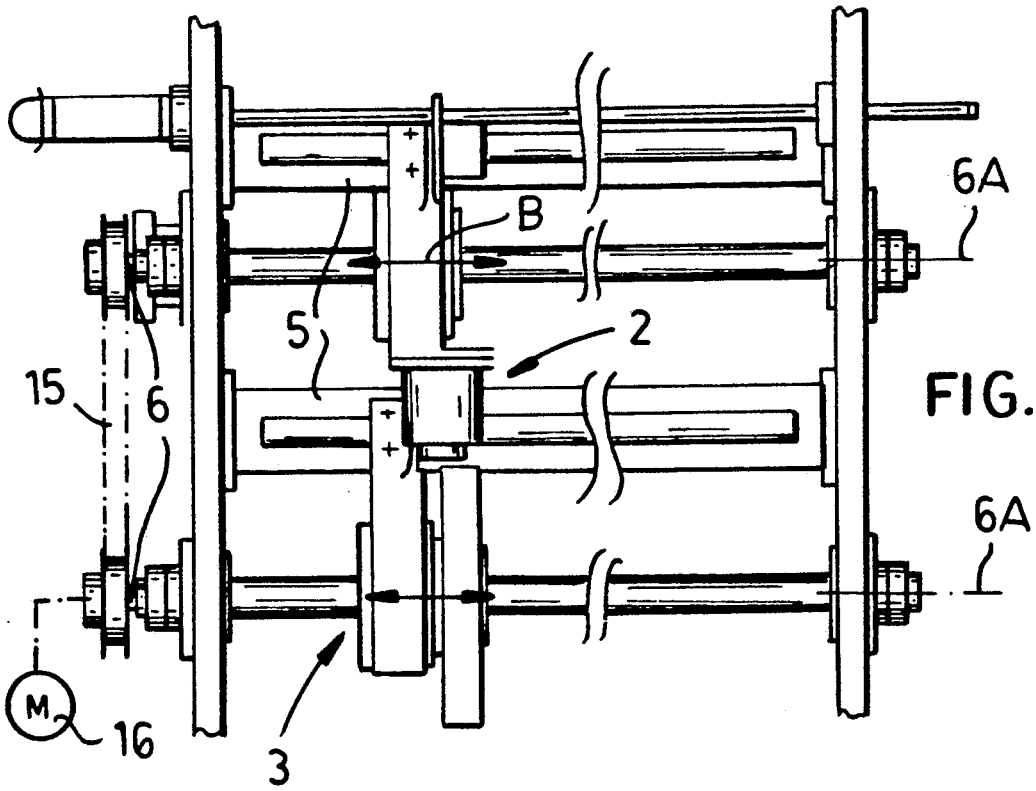
FIG. 2 is a top view of the apparatus.

Thus to adjust the transverse position in the adjustment direction shown at B in FIG. 2 the actuator 13 is pressurized to push the half nut 7 into mesh with the rod 6 and to disengage the clamping shoe 9 from the rod 8. Then the motor 16 rotates the rod 6 to screw the holder 4 in the desired direction transverse of the direction D until the desired position is reached. The actuator 12 is then pressurized to disengage the nut 7 from the rod 6 and to clamp the holder 4 to the rod 8 by means of the shoe 9.

We claim:

1. An apparatus for longitudinally cutting a longtiduinally moving web, the apparatus comrising:

upper and lower guides flanking the web and extending transversely thereof parallel to each other;

respective upper and lower blade holders riding on and displaceable along the guides transversely of the web;

respective upper and lower blades on the holders engageable with the web;

respective upper and lower threaded adjustment spindles extending through the holders;

respective upper and lower half nuts displaceable on the holders between coupled positions threadedly engaging the respective spindles and coupling the respective holders thereto and uncoupled positions out of engagement with the respective spindles;

respective upper and lower clamping rods extending through the holders;

respective upper and lower clamping shoes displaceable on the holders between clamping positions engaging the respective spindles and locking the respective holders thereon and released positions out of engagement with the respective spindles;

respective upper and lower coupling means interconnecting each clamping shoe with the respective half nut for synchronous and simultaneous movement of each clamping shoe with the respective half nut;

respective actuating means for displacing the half nuts of the respective holders into the coupled position and for simultaneously displacing the respective shoes coupled thereto by the coupling means into the released position in an adjustment mode and for displacing the half nuts of the holders into the uncoupled positoins and for simultaneously displacing the shoes into the blocking positoin in a cutting mode; and drive means for rotating the spindles and thereby transversely displacing the holders and blades only in the adjustment mode of the actuating means.

2. The cutting apparatus defined in claim 1 wherein the actuating means includes a respective fluid-powered piston-and-cylinder unit braced between each half nut and the respective holder.

3. The cutting apparatus defined in claim 1 wherein the actuating means includes a respective fluid-powered piston-and-cylinder unit braced between each clamping shoe and the respective holder.

4. The cutting apparatus defined in claim 1 wherein the drive means includes a drive element interconnecting the threaded spindles for joint synchronous rotation.

5. The cutting apparatus defined in claim 1 wherein each holder is formed with at least one guide bore extending between the respective half nut and shoe, the coupling means comprising a tie rod slidable in the guide bore and having one end fixed in the half nut and an opposite end fixed in the shoe.

* * * * *